United States Patent [19]

Schmitz

[11] 4,053,115

[45] Oct. 11, 1977

[54] FABRIC PROTECTING MEANS

[75] Inventor: Herbert Schmitz, Kitchener, Canada

[73] Assignee: Uniroyal Ltd., Ontario, Canada

[21] Appl. No.: 677,201

[22] Filed: Apr. 15, 1976

Related U.S. Application Data

[63] Continuation-in-part of Ser. No. 506,081, Sept. 16, 1974, abandoned.

[30] Foreign Application Priority Data

Aug. 15, 1974 Canada ..... 207103

[51] Int. Cl.[2] ..... B65H 75/02; B65H 75/28

[52] U.S. Cl. ..... 242/77.1; 206/412

[58] Field of Search ..... 242/62, 77.1, 1, 55; 206/412

[56] References Cited

U.S. PATENT DOCUMENTS

| | | | |
|---|---|---|---|
| 2,225,921 | 12/1940 | Murdock et al. | 242/55 |
| 2,811,248 | 10/1957 | Hill et al. | 242/77.1 X |
| 3,420,365 | 1/1969 | Bailey | 242/1 |
| 3,674,222 | 7/1972 | Smiley | 242/77.1 |
| 3,775,229 | 11/1973 | Beckers | 242/77.1 X |
| 3,797,647 | 3/1974 | Frishman | 242/77.1 X |

*Primary Examiner*—George F. Mautz
*Assistant Examiner*—John M. Jillions
*Attorney, Agent, or Firm*—Charles A. Blank

[57] ABSTRACT

The pile surfaces of high pile and velour fabrics are protected during shipment and storage by an improved fabric protecting means which comprises an elongate, flexible carrier strip. Upwardly and downwardly disposed fabric engaging means are integral with the carrier strip. The upwardly disposed fabric engaging means in one embodiment comprises two parallel rows of loops adjacent to the side edges of the carrier strip. The douwnwardly disposed fabric engaging means in the same embodiment comprises a row of loops between the two parallel rows but secured to the opposite surface of the carrier strip. When the lateral side or selvage edges of the fabric are placed into contact with these loops in a rolled, wrapped configuration, they firmly and securely grip and engage the fabric with the carrier strip. The fabric, with the protecting means secured thereto, is wound on a windup roll so that no wrap of the fabric compresses an adjacent wrap, thereby preventing the pile surface from becoming matted down or otherwise marred.

30 Claims, 32 Drawing Figures

2A
2A
10
11
11a
11b
11d
12
12a
12b
13

Fig.9.
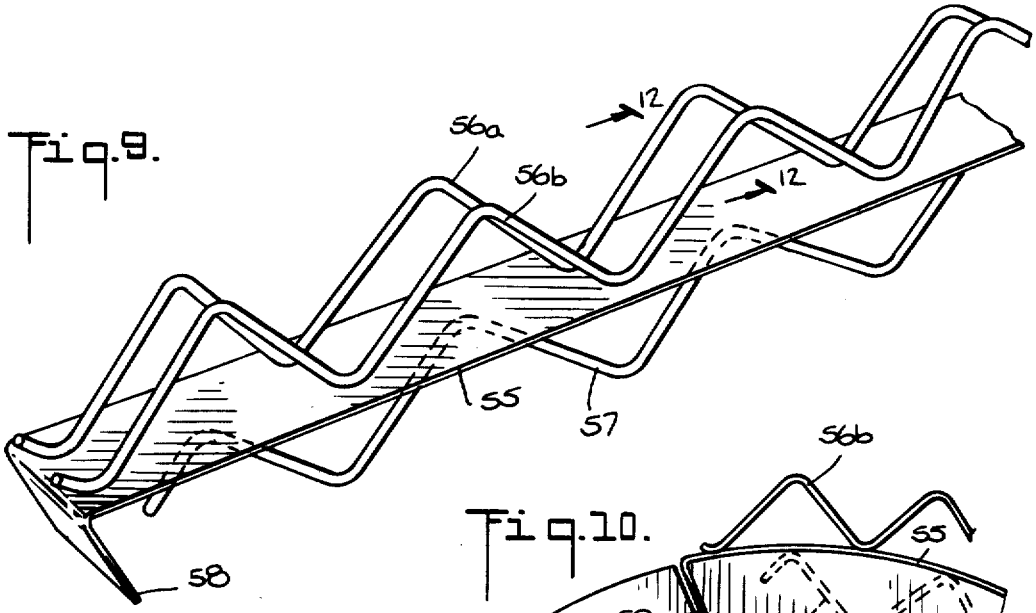
Fig.10.
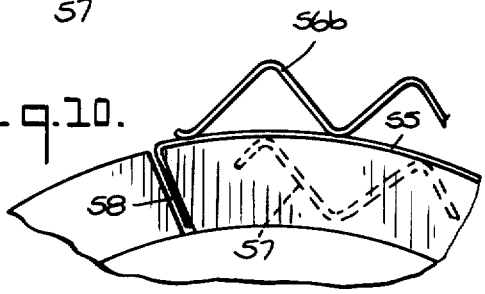
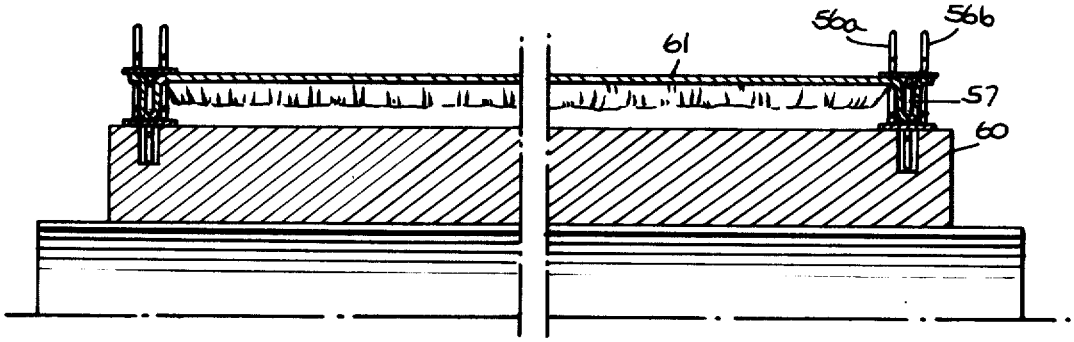
Fig.11.
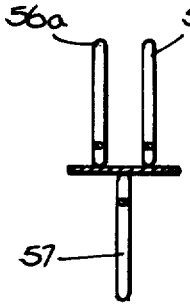
Fig.12.
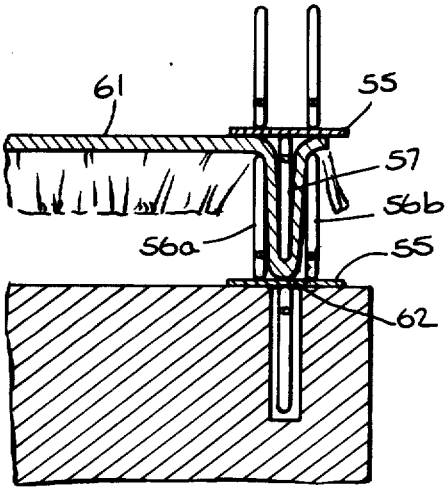
Fig 13.

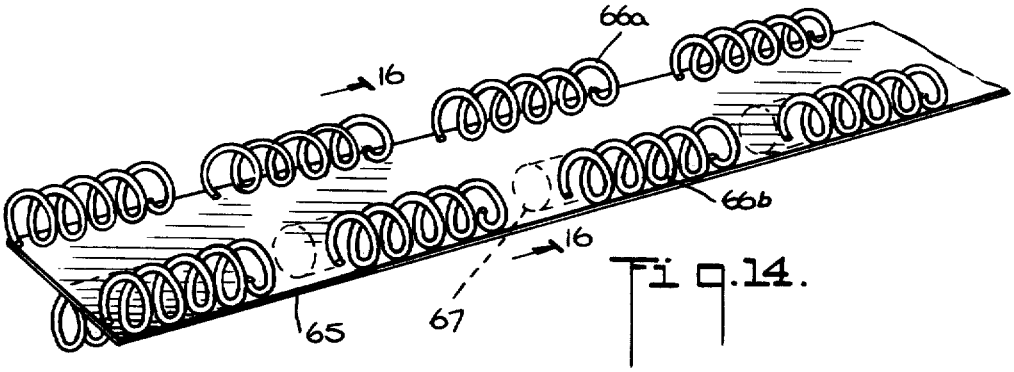
Fig.14.
Fig.15.
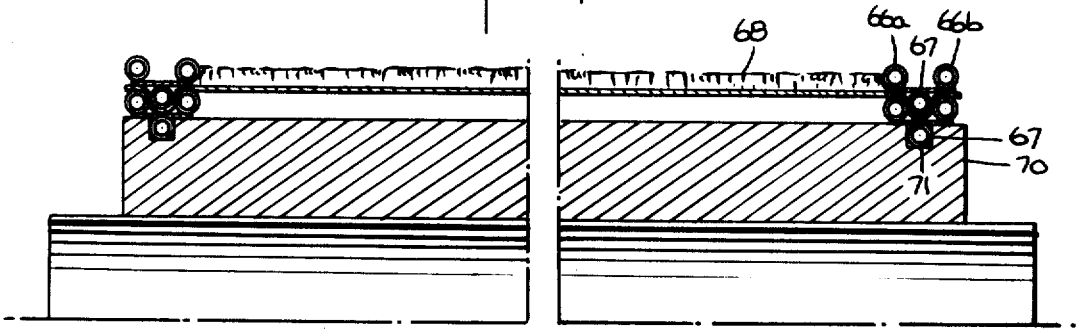
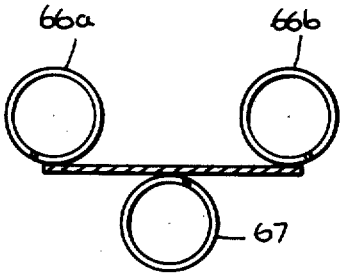
Fig.16.
Fig.17.
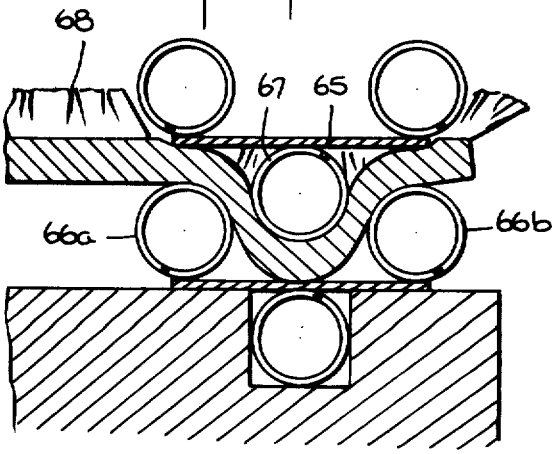

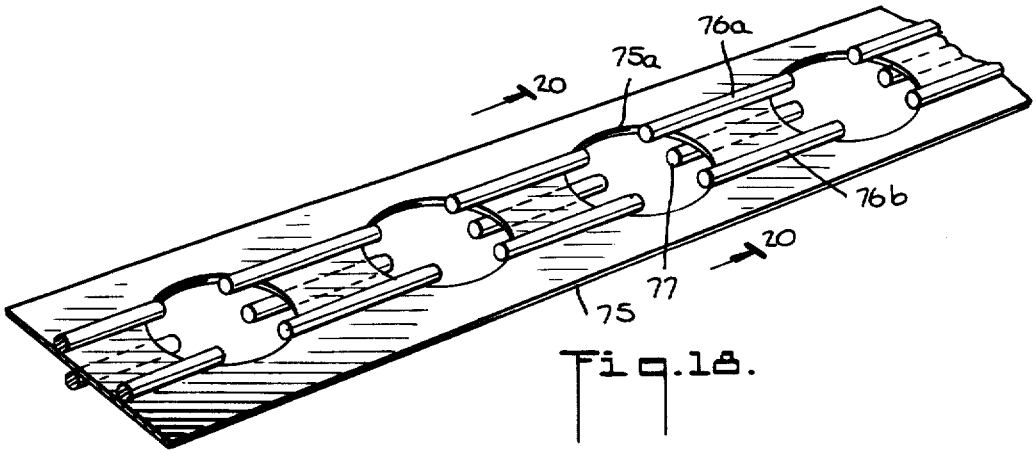
Fig.18.
Fig.19.
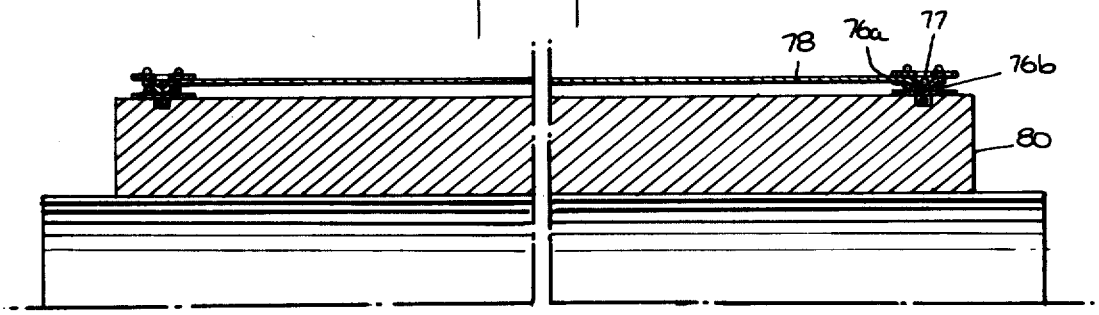
Fig.20.
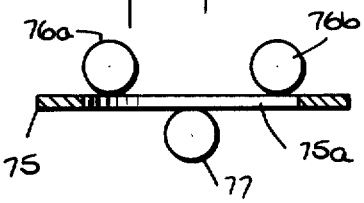
Fig.21.
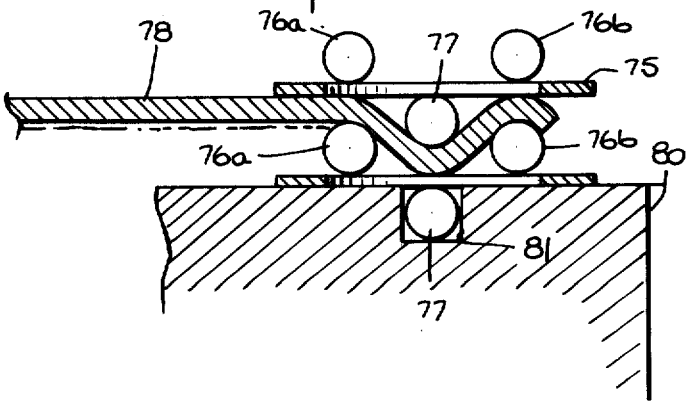

18
18
99
100a
100b 18
100c
100c
100a
100c
100b 97
102b
103
98
102a
101

FABRIC PROTECTING MEANS

This application is a continuation-in-part of my copending application Ser. No. 506,081, filed Sept. 16, 1974, now abandoned.

This invention relates to an improved method and means for winding pile fabrics, such as velvets, tufted rugs, tufted upholstery and similar fabrics, in such a way as to relieve the compressing pressure on the pile or tufts of the fabric as the fabric is collected and wound upon a windup roll, thereby preventing matting of the fabric and any consequent damage to the appearance of its pile surface.

BACKGROUND OF THE INVENTION

Fabrics, including pile fabrics, are customarily rolled into rolls for storage and shipment. When stored or piled, any continual pressures causing the surface of the fabric of one wrap to be pressed against the backing of the fabric in an immediately adjacent wrap tends to mat down or otherwise flatten and mar the surface of the fabric. This problem is especially troublesome in pile fabrics such as velvets, tufted rugs, tufted uphosltery and similar surface-textured fabrics.

In U.S. Pat. No. 3,674,222 to Smiley, a method and means are disclosed for winding pile fabrics and collecting them on a windup roll in such a way as to eliminate or diminish the pressure exerted on the face of the pile fabric within the roll. To accomplish this a strip is attached to the fabric at each side thereof, that is, along each selvage edge of the fabric, so that the strip extends longitudinally along the selvage edges of the fabric. This strip resembles a long narrow tape having an attaching tab along one edge thereof. Preferably, this strip is sewn on to the selvage edge of the fabric, but it can also be cemented to the fabric or attached thereto by any other conventional means. The strip has two shoulders, preferably formed from corrugated paper, one shoulder of which projects upwardly from the longitudinal mid-plane of the strip and the second shoulder of which projects downwardly at one side edge of the strip so that an attaching tab is formed at the other side edge of the strip. In other words, the upwardly projecting shoulder is closest to the attaching tab portion while the downwardly projecting shoulder extends along the other edge of the tape. Thus, the attaching tab lies along one edge of the tape, the downwardly projecting shoulder lies along the other edge of the tape, and the upwardly projecting shoulder is disposed intermediate the attaching tab edge and the downwardly projecting shoulder.

Since the upwardly and downwardly projecting shoulders are made of corrugated paper and are therefore relatively wide, the inner edge of the downwardly projecting shoulder is aligned with the outer edge of the upwardly projecting shoulder so that as the tape is wound on a roll, these shoulders meet with the two edges bearing against each other so that the attaching tab is wound along a helical path. These shoulders act as spacers between succeeding wraps of the tape and the height of at least one of the shoulders is at least equal to, and preferably slightly greater than, the height of the pile in the fabric to which the tape is to be attached and used.

Means are also disclosed in this patent for winding a pile fabric with the tape secured to its selvage edges on a collecting core. The core is provided with flange means on each end having radial faces adapted to bear against the inner face of the downwardly projecting shoulder on the first or initial wrap of the tape secured to the fabric about the core. These radial faces are spaced apart a distance sufficient to hold the fabric taut as it is wrapped about the core with the inner face of the downwardly projecting shoulder bearing against the radial face of the flange. Succeeding wraps of the fabric and the tape are wound on the core with the inner face of the downwardly projecting shoulder bearing against the outer face of the upwardly projecting shoulder of the preceding wrap so that the shoulders in each succeeding wrap are held in the same radial plane and the fabric in each succeeding wrap is maintained taut.

While the above described means disclosed in U.S. Pat. No. 3,674,222 to Smiley were found to be effective for their intended purpose, they have limitations. For example, it is costly and time-consuming to attach the tab to the selvage edges of the fabric and time-consuming and difficult to unroll the fabric from the collecting core and remove the fabric from the tape. In addition, it is difficult to impart and maintain sufficient transverse stretch or tension in the fabric as the tab is attached to it and as the fabric with the attached tab is collected on the core.

THE INVENTION

The limitations noted above with respect to U.S. Pat. No. 3,674,222 to Smiley are now overcome by using the fabric protecting means of this invention which is of simple construction and requires the use of simpler associated apparatus for securing it to the selvage edges of a pile fabric. Use of the fabric protecting means of the invention permits it to be secured to the lateral side or selvage edges of a pile fabric by bringing the fabric into contact with the fabric protecting means while the fabric is under transverse tension or stretch, for example, by means of a pin belt conveyor. This mechanical securing of the fabric protecting means to the pile of the pile fabric enables the fabric to retain its stretched condition as it is collected on a windup roll. Furthermore, the assembled fabric protecting means permits sufficient spacing to be retained between successive layers or wraps of the fabric on the windup roll thereby preventing and substantially further reducing any matting or marring of the pile after it has been collected on the windup roll. In addition, use of the new and improved fabric protecting means results in reduced overall package lengths, and enables the fabric to be more easily unwound from the windup roll.

In accordance with the invention, a fabric protecting means for collecting, shipping and storing the fabric, comprises an elongate, flexible carrier strip. The fabric protecting means also includes upwardly disposed means integral with the carrier strip for gripping and engaging the fabric and downwardly disposed means integral with the carrier strip for gripping and engaging the fabric. The height of each of the upwardly and downwardly disposed means is at least equal to the thickness of the fabric. The upwardly and downwardly disposed means for gripping and engaging the fabric are closely spaced adjacent to each other such that the upwardly disposed means mechanically grips and engages the fabric with the downwardly disposed means upon being placed in contact with the fabric in a rolled, wrapped configuration.

Also in accordance with the invention, a pile fabric protecting means for collecting, shipping and storing fabric, comprises an elongate, flexible carrier strip. The fabric protecting means also includes upwardly disposed means integral with the carrier strip for gripping and engaging the fabric and downwardly disposed means integral with the carrier strip for gripping and engaging the fabric. The upwardly and downwardly disposed means for gripping and engaging the fabric are each at least equal to the height of the pile on the fabric to which the protecting means is to be secured. The upwardly and downwardly disposed means for gripping and engaging the fabric are closely spaced adjacent to each other such that the upwardly disposed means mechanically grips and engages the fabric with the downwardly disposed means upon being placed into contact with the fabric in a rolled, wrapped configuration.

Also in accordance with the invention is the combination which comprises a pile fabric, the pile of which is to be protected and a fabric protecting means mechanically gripping and engaging the selvage edges of the fabric. The fabric protecting means comprises an elongate, flexible carrier strip, upwardly disposed means for gripping and engaging the fabric and downwardly disposed means for gripping and engaging the fabric. The upwardly and downwardly disposed means are secured to opposite surfaces of the carrier strip and each comprises parallel rows of a plurality of closed end loops made of rigid wire and formed into a continuous wave-like configuration. The height of the loops is at least equal to the height of the pile of the fabric to be protected and the protruding extremities of the closed end loops are closely spaced adjacent to other such that the closed end loops of the upwardly disposed means mechanically grip and engage the fabric with the closed end loops of the downwardly disposed means upon being placed into contact with the fabric with the upwardly disposed means engaging the fabric inwardly spaced from its selvage edge and the downwardly disposed means engaging the fabric adjacent its selvage edge.

Also in accordance with the invention, a fabric protecting means for protecting, shipping and storing fabric, comprises an elongate, flexible carrier strip and upwardly disposed means integral with the carrier strip for engaging the fabric and downwardly disposed means integral with the carrier strip for engaging the fabric. The height of each of the upwardly and downwardly disposed means is at least equal to the thickness of the fabric. The upwardly and downwardly disposed means for engaging the fabric are closely spaced adjacent to each other. The upwardly and downwardly disposed means are jointly effective to mechanically grip and engage the fabric with the carrier strip upon the upwardly and downwardly disposed means being placed into contact with the fabric in a rolled, wrapped configuration.

Also in accordance with the invention, a pile fabric protecting means for collecting, shipping and storing fabric, comprises an elongate, flexible carrier strip and upwardly disposed means integral with the carrier strip for engaging the fabric and downwardly disposed means integral with the carrier strip for engaging the fabric. The upwardly and downwardly disposed means for engaging the fabric each are at least equal to the height of the pile in the fabric to which the protecting means is to be secured. The upwardly and downwardly disposed means for engaging the fabric are closely spaced adjacent to each other. The upwardly and downwardly disposed means are jointly effective to mechanically grip and engage the fabric with the carrier strip upon being placed into contact with the fabric in a rolled, wrapped configuration.

Also in accordance with the invention is the combination which comprises a pile fabric, the pile of which is to be protected and a pair of fabric protecting means for mechanically gripping and engaging the selvage edges of the fabric. Each of the fabric protecting means comprises an elongate, flexible carrier strip and upwardly disposed means for engaging the fabric and downwardly disposed means for engaging the fabric. The upwardly and downwardly disposed means are secured to opposite surfaces of the carrier strip. The upwardly disposed means comprises two parallel rolls of loops adjacent to the side edges of the carrier and made of rigid wire and the downwardly disposed means comprises a row of loops between the two parallel rows but secured to the opposite surface of the carrier strip and made of rigid wire. The height of the loops is at least equal to the height of the pile of the fabric to be protected and the rows of loops are closely spaced adjacent to each other, the loops of the upwardly and downwardly disposed means being jointly effective to mechanically grip and engage the fabric with the carrier strip when in contact with the fabric in a rolled, wrapped configuration.

Also in accordance with the invention is a combination which comprises a fabric which is to be protected and a pair of fabric protecting means for mechanically gripping and engaging the selvage edges of the fabric. Each of the fabric protecting means comprises an elongate, flexible carrier strip and upwardly disposed means for engaging the fabric and downwardly disposed means for engaging the fabric. The upwardly and downwardly disposed means comprises portions of the carrier strip extending upwardly and downwardly, respectively, therefrom. The upwardly disposed means comprises two parallel rows of portions of the carrier strips extending in the upwardly direction therefrom and the downwardly disposed means comprises a row of portions of the carrier strip located between the aforesaid two parallel rows but extending downwardly from the carrier strip. The height of the upwardly and downwardly extending portions is at least equal to the thickness of the fabric. The rows of upwardly and downwardly extending portions are closely spaced adjacent to each other, the upwardly and downwardly extending portions being jointly effective to mechanically grip and engage the fabric with the carrier strip upon being placed into contact with the fabric in a rolled, wrapped configuration.

Also in accordance with the invention is the combination which comprises a fabric which is to be protected and a pair of fabric protecting means for mechanically gripping and engaging the selvage edges of the fabric. Each of the fabric protecting means comprises an elongate, flexible carrier strip and upwardly disposed means for engaging the fabric and downwardly disposed means for engaging the fabric. The upwardly and downwardly disposed means comprise rows of rods secured to opposite surfaces of the carrier strip. The upwardly disposed means comprises two parallel rows of rods adjacent to side edges of the carrier strip and the downwardly disposed means comprises a row of rods between the two parallel rows but secured to the opposite surface of the carrier strip. The thickness of the rods is at least equal to the thickness of the fabric. The rows of rods are closely spaced adjacent to each other, the rods of the upwardly and downwardly disposed means being jointly effective to mechanically grip and engage the fabric with the carrier strip, when in contact with the fabric in a rolled, wrapped configuration.

One embodiment of the new and improved protective means of the invention comprises an elongate, flexible carrier strip, upwardly disposed fabric gripping and engaging means secured to said carrier strip, and downwardly disposed fabric gripping and engaging means secured to said carrier strip on the opposite surface thereof. Each of the fabric gripping and engaging means comprises a plurality of loops which are closed at their protruding extremities and are preferably made from rigid wire to form a continuous, wave-like configuration. Adjacent loops in each fabric engaging means are closely spaced to each other so that these loops can mechanically engage and grip the fabric when the fabric engaging means are placed into contact with selvage edges of the fabrics. When securing the improved protective means to the selvage edges of a fabric, the upwardly disposed fabric engaging means is positioned inwardly from the selvage edge while the downwardly disposed fabric engaging means is positioned adjacent the selvage edge.

Although the loops forming each of the fabric gripping and engaging means can be of different heights, and be completely offset from each other, the loops of one of the gripping and engaging means are at least as high as the height of the pile of the fabric to be protected. Preferably, the loops are of the same height with the loops of at least one of the fabric engaging means being higher than the height of the pile of the fabric to be protected. In addition, these loops are also preferably offset so that the upwardly disposed loops overlap the downwardly disposed loops by more than about 50%.

Prior to contacting the fabric with the protecting means of the invention, the fabric is transversely tensioned or stretched and retained substantially in this condition as the fabric gripping and engaging means are brought into contact with the fabric. While in this condition, for example, on a pin-belt conveyor, the fabric, with the protecting means mechanically engaging the fabric, is collected on a windup roll. In order to initially secure the protecting means to the windup roll, the windup roll is preferably formed to have a groove adjacent each of its axial ends into which the first wrap of the downwardly projecting fabric engaging means is placed and one complete revolution of the windup roll is made before the fabric is placed in contact with the fabric protecting means.

The structural details and novel features of the new and improved fabric protecting means of the invention will become more apparent from the ensuing description when considered together with the accompanying drawings wherein the several figures illustrate preferred embodiments thereof and wherein:

FIG. 9 is a fragmentary perspective view of a preferred embodiment of the fabric protecting means of the present invention;

FIG. 10 is a fragmentary perspective view of the FIG. 9 fabric protecting means mounted on a flange represented more fully in FIG. 27 to FIG. 30, inclusive;

FIG. 11 is a fragmentary sectional view of the FIG. 9 fabric protecting means mounted on a wind-up roll generally similar to that of the FIG. 5 embodiment;

FIG. 12 is a sectional view of the FIG. 9 fabric protecting means taken along line 12—12 of FIG. 9;

FIG. 13 is an enlarged fragmentary view of a portion of the FIG. 11 apparatus;

FIG. 14 is a fragmentary perspective view of a preferred embodiment of the fabric protecting means constructed in accordance with the invention;

FIG. 15 is a fragmentary sectional view of the fabric protecting means of FIG. 14 mounted on a roll similar to the FIG. 5 roll;

FIG. 16 is an enlarged sectional view of the FIG. 14 fabric protecting means taken along line 16—16 of FIG. 14;

FIG. 17 is an enlarged fragmentary view of the FIG. 15 apparatus;

FIG. 18 is a fragmentary perspective view of a fabric protecting means particularly suitable for protecting velour pile fabrics;

FIG. 19 is a fragmentary sectional view of the FIG. 18 fabric protecting means mounted on a wind-up roll similar to that of FIG. 5;

FIG. 20 is an enlarged sectional view of the FIG. 18 fabric protecting means taken along line 20—20 of FIG. 18;

FIG. 21 is an enlarged fragmentary view of the FIG. 18 apparatus;

Figures 1, 2A, 2B:
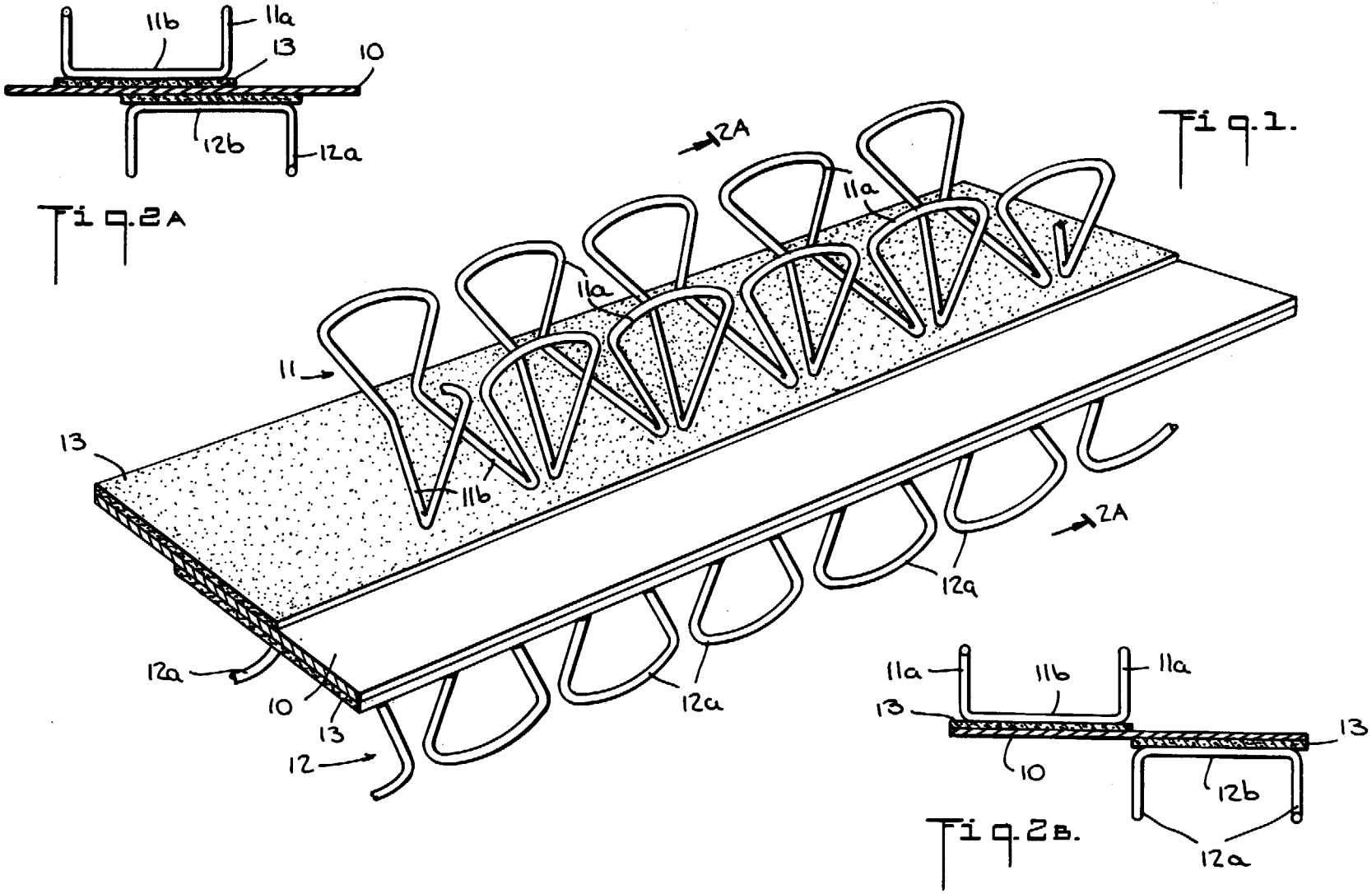
FIG. 1 is a fragmentary perspective view of the new and improved fabric protecting means of the invention.
FIG. 2A is a sectional view taken substantially on line 2A—2A of FIG. 1 and illustrating a preferred embodiment of the relative offset positions of the gripping and engaging components of the protecting means of the invention.
FIG. 2B is a view similar to that of FIG. 2A illustrating another embodiment of the relative offset positions of the gripping and engaging components of the protecting means of the invention.

As shown in FIG. 1, the fabric protecting means of the invention comprises an elongate support or carrier strip 10 which can be formed from any suitable material such as stiff paper, cardboard, corrugated paper, plastic, and the like, which is capable of being flexed and wound into a roll and yet is of sufficient strength to support and carry the gripping and engaging means 11, 12. Fabric gripping and engaging means 11 is preferably formed from two parallel rows of upwardly disposed, closed-end loops 11*a* whose lower connecting ends 11*b* are secured adjacent to one side edge of support means 10 parallel to its longitudinal axis, securing of the fabric engaging means 11 to support means 10 being by any suitable means such as an adhesive as indicated by reference numeral 13. Fabric engaging means 11 is secured to that side edge of support means 10 that will be positioned inwardly from the selvage edge of a length of fabric. Downwardly disposed fabric engaging means 12 is also formed from two parallel rows of closed-end loops 12*a* which are secured to the other surface of support means 10 at the opposite side edge than that of fabric engaging means 11 so that fabric engaging means 12 will be positioned adjacent to the selvage edge of a length of fabric.

Figure 5:
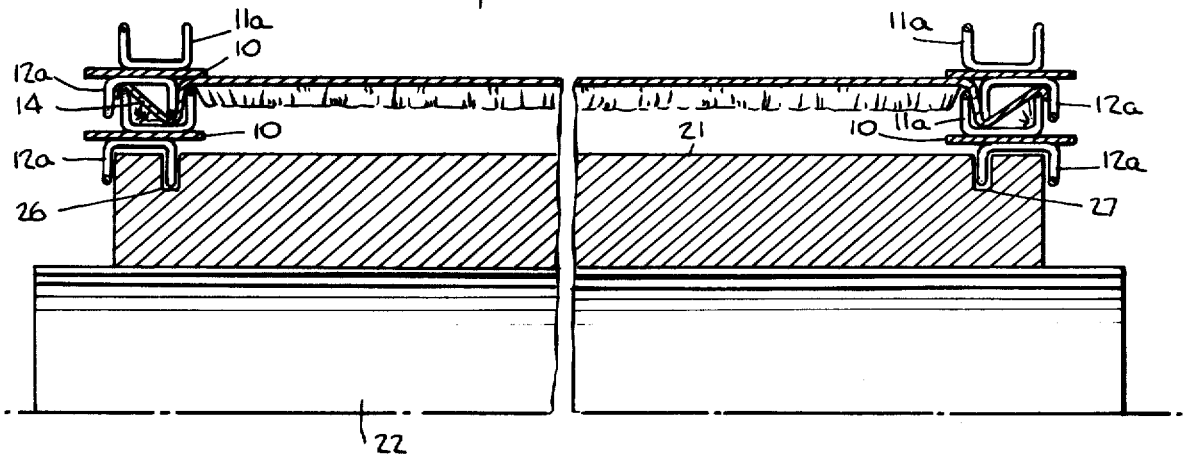
FIG. 5 is an enlarged fragmentary axial sectional view of the fabric protecting means of the invention taken substantially on line 5—5 of FIG. 3 and illustrating the manner in which the fabric is mechanically gripped and engaged by the protecting means of the invention and then wound up on a windup roll.
Figure 6:
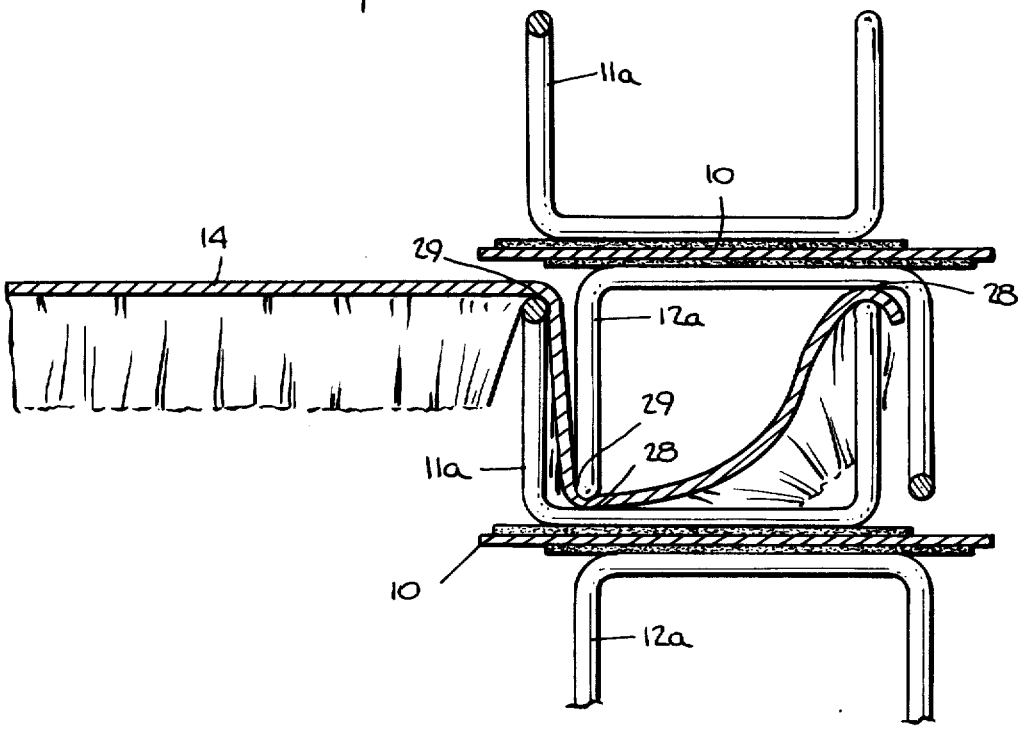
FIG. 6 is an enlarged, fragmentary view showing the details of a portion of the means illustrated in FIG. 5.

Fabric engaging means 11, 12 can be made from any suitable material such as plastic or metal, but are preferably formed from rigid metal wire which can be readily made into a continuous wave-like loop configurations, with the protruding closed outer ends of each adjacent loop spaced closely together as clearly shown in FIG. 1. The individual loops 11*a*, 12*a* can be of different size and height but are preferably of the same size and height. With respect to each other, loops 11*a*, 12*a* can be positioned so that the longitudinal center lines of their connecting ends 11*b*, 12*b* are slightly offset as shown in FIG. 2A or positioned so that these longitudinal center lines are completely offset with no overlap between connecting ends 11*b*, 12*b* as shown in FIG. 2B. Loops 11*a*, 12*a* are positioned so that longitudinal center lines of their connecting ends are only slightly offset from each other as shown in FIG. 2A with at least 50% overlap between them. Preferably loops 11*a*, 12*a* are positioned with at least about 90% overlap between them as represented in FIGS. 5 and 6. This configuration has been found best to obtain maximum gripping and engaging of a fabric and for retaining the fabric under tension after the fabric has been wound on a collecting roll.

Figure 3:
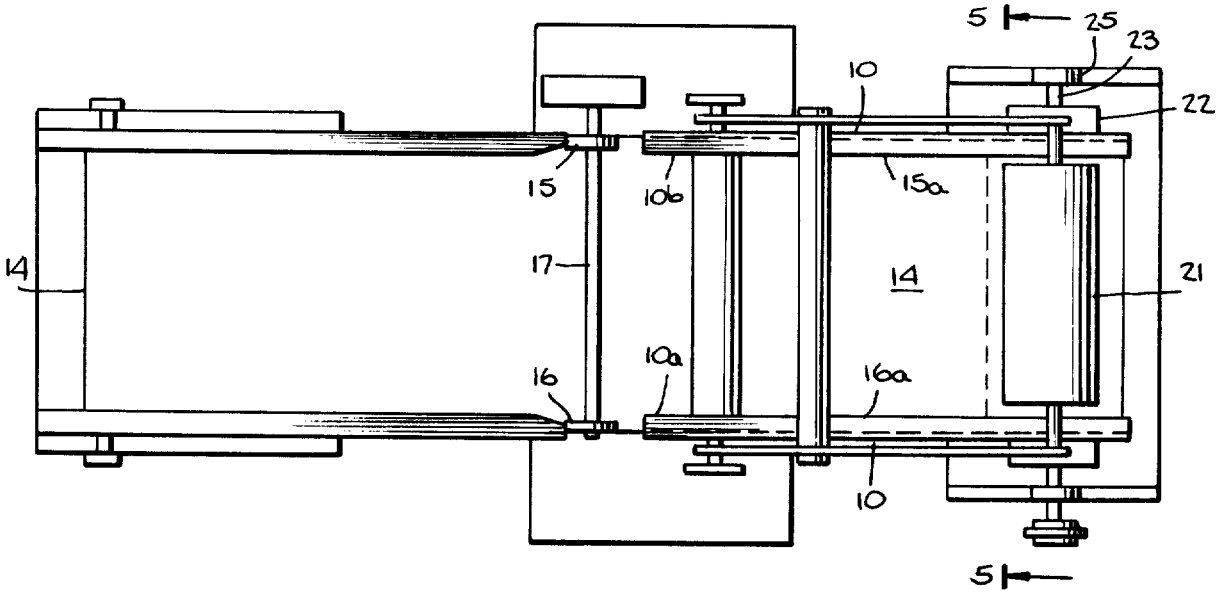
FIG. 3 is a schematic plan view illustrating one embodiment of associated apparatus which can be used to secure the fabric protecting means of the invention to a fabric.
Figure 4:
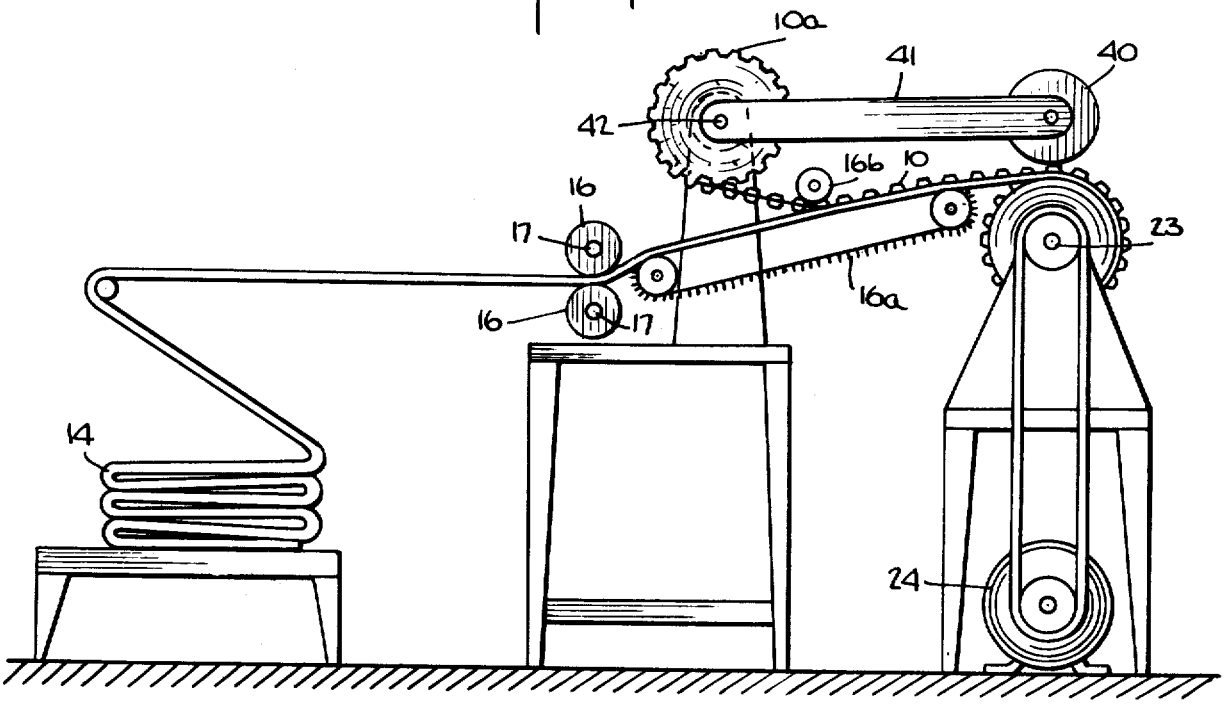
FIG. 4 is an elevational view of the means shown in FIG. 3.

FIGS. 3 and 4 schematically illustrate one method and associated apparatus which can be used for attaching strips 10 to the selvage edges of a fabric. As shown in FIGS. 3 and 4, a fabric 14 to be protected is fed from a suitable source of supply to tensioning and stretching apparatus comprising a pair of opposed, toothed spindles 15, 16. Spindles 15, 16 are of the type and kind generally known to and used by those skilled in the art, such as tentering apparatus, to grip and then stretch or tension a fabric transverse to its longitudinal axis by gripping opposed selvage edges of a fabric and pulling these edges in opposite directions until the fabric is stretched a predetermined amount. Stretching or tensioning of the fabric is achieved by means of spring loaded rotatable shafts upon which spindles 15, 16, respectively, are mounted. Since all fabrics are extensible to some extent, whether woven or knitted from naturally derived or synthetically produced materials, fabric 14 can be tensioned or stretched about 3% to 10% its normal width, preferably about 5% to 7%. Thus, a fabric measuring about 50 inches in width when at rest would be stretched to about 53 to 54 inches before fabric engaging means 11, 12 are placed into engagement with the fabric.

As fabric 14 is fed through and stretched by spindles 15, 16, strip 10 is concurrently fed from a supply source, such a from rolls 10*a*, 10*b*, and fed onto pin-belt conveyor 15*a*, 16*a* under a hold-down roll 16*b* to each lateral side or selvage edge of fabric 14 and placed into contact with the fabric. Fabric 14 and strip 10 are then advanced to a wind-up roll 21 about which successive wraps of fabric 14 and strip 10 are wound under a suitable hold-down roll 40 pivotable on arm 41 about shaft 42.

Although fabric 14 can be fed to wind-up roll 21 under the initial tension imparted to it, this tension is preferably eased slightly before fabric 14 is wound on wind-up roll 21. Alternatively, strip 10 can be positioned with respect to fabric 14 while fabric 14 is only under that amount of tension sufficient to eliminate wrinkles and folds. Fabric 14 and strip 10 can be wound on wind-up roll 21 and, assuming roll 21 is split transversely into two parts, tensioning and stretching of the fabric can then be accomplished while the fabric is rolled on wind-up roll 21 by moving, for example, the right-hand part to the right slightly, for example, about one inch.

Wind-up roll 21 has a hollow core into which a sleeve 22 is inserted. Either hollow wind-up roll 21 or sleeve 22 or both can be provided with suitable means so that they can be securely locked to each other thereby permitting wind-up roll 21 to be rotated as sleeve 22 is rotated. Sleeve 22 is mounted on shaft 23, one end of which is connected to a drive means, such as motor 24, while its other end is mounted for free rotation in a suitable housing as indicated at 25. Thus, sleeve 22, shaft 23 and motor 24 are the means by which wind-up roll 21 is driven and also provide the means by which fabric 14 with strip 10 attached thereto is advanced to and wrapped about wind-up roll 21 after strip 10 has been initially attached to fabric 14.

As shown in FIG. 5, strip 10 is initially secured to wind-up roll 21 by inserting loops 12*a* of the downwardly projecting fabric protecting means 12, into circumferential grooves 26, 27 formed adjacent each axial end of wind-up roll 21. Loops 12*a* can be secured in grooves 26, 27 by any suitable means such as a spring clip positioned in each groove 26, 27 (not shown) to engage the loops 12*a* and by taking a full turn of wind-up roll 21 with loops 12*a* positioned in grooves 26, 27 before beginning to engage the selvage edges of fabric 14 with the upwardly and downwardly projecting fabric protecting means 11, 12. Similarly, the selvage edges of fabric 14 can be initially secured by loops 11*a* of the upwardly disposed fabric engaging means 11 and by loops 12a of the downwardly disposed fabric engaging means during the second turn of the wind-up roll and during the following turns thereof, causing fabric 14 to follow a serpentine path as successive wraps of fabric 14 are wound up on wind-up roll 21 as clearly illustrated in FIGS. 5 and 6. It has been found that merely placing the fabric 14 into engagement with loops 11a, 12a is sufficient to have the fabric firmly and securely gripped and engaged by and between these closely spaced loops 11a, 12a.

The serpentine or tortuous path that the selvage edges of fabric 14 are forced to follow after being firmly gripped and engaged by loops 11a and 12a during successive wraps of the fabric 14 about wind-up roll 21 not only creates compression points, such as indicated by reference numeral 28, as the fabric is gripped by and between loops 11a and 12a, but also increases the force of friction between the fabric 14 and loops 11a and 12a at those points where fabric 14 is engaged between loops 11a and 12a, as indicated by reference numeral 29. This pinching and compressing at points 28 coupled with increase in the force of friction between fabric 14 and loops 11a and 12a as shown at reference numeral 29, serves to securely lock the fabric 14 between adjacent loops 11a and 12a and also enables the initial tension or stretch imparted to fabric 14 to be maintained as fabric 14 is collected on wind-up roll 21. Thus, this stretch or tension is also maintained during storage or shipment until fabric 14 is ready to be unwound from wind-up roll 21.

Figures 7, 8:
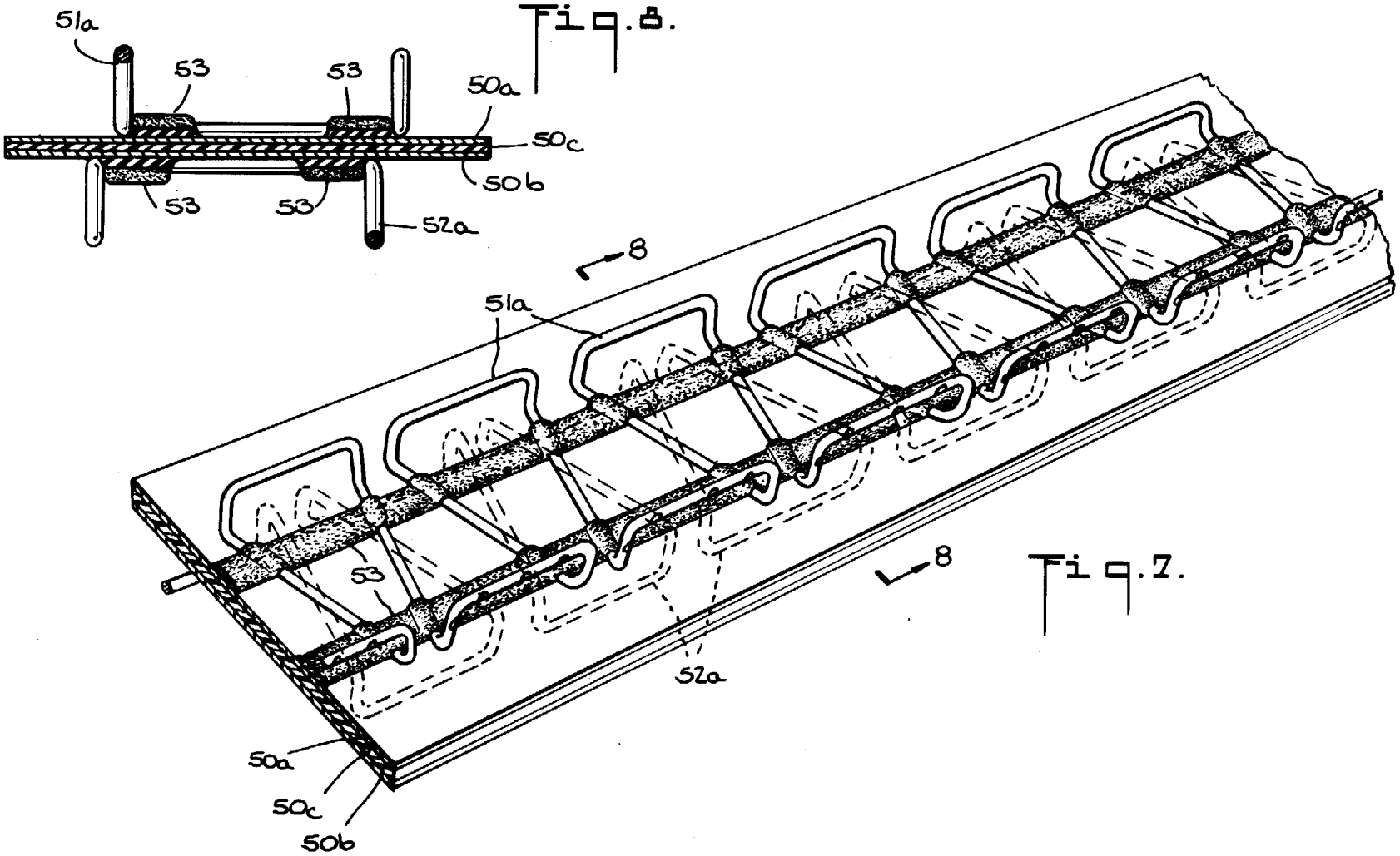
FIG. 7 is a fragmentary perspective view of another embodiment of the fabric protecting means constructed in accordance with the invention which is similar to the FIG. 1 embodiment.
FIG. 8 is a sectional view taken along the line 8—8 of FIG. 7.

Referring now to FIGS. 7 and 8, there is represented an embodiment of the invention which is generally similar to the FIG. 1 embodiment but is of different proportions. Upwardly disposed loops of rigid wire 51a are attached to a heavy paper strip 50a by a suitable adhesive such as epoxy ribbons 53. Downwardly disposed loops 52a are similarly attached to a heavy paper strip 50b. The paper strips 50a, 50b are adhered together by a suitable adhesive 50c. The upwardly disposed loops 51a and the downwardly disposed loops 52a are each at least equal to the height of the pile on the fabric (not shown). Loops 51a and 52b preferably are positioned with at least about 90% overlap between them as represented in FIG. 8.

Referring now more particularly to FIGS. 9 and 12 of the drawings, a fabric protecting means comprises an elongate flexible carrier strip 55 which preferably is of metal. The fabric protecting means comprises upwardly disposed means 56a, 56b integral with the carrier strip for engaging the fabric and downwardly disposed means 57 integral with the carrier strip 55 for engaging the fabric. The upwardly and downwardly disposed means 56 and 57 preferably comprise parallel rows of loop secured to the surfaces of the carrier strip, for example, by welding, the loops individually preferably comprising rigid metal wires 56a, 56b and 57 extending continuously longitudinally along the carrier strip 55. The height of each of the upwardly and downwardly disposed means 56a, 56b and 57 preferably is at least equal to the thickness of the fabric to be protected. The upwardly and downwardly disposed means 56a, 56b and 57 are closely spaced adjacent to each other. The upwardly and downwardly disposed means 56a, 56b and 57 are jointly effective to mechanically grip and engage the fabric with the carrier strip 55 upon the upwardly and downwardly disposed means 56a, 56b and 57 being placed into contact with the fabric in a rolled, wrapped configuration.

The height of each of the upwardly and downwardly disposed means 56a, 56b and 57 is at least equal to the height of the pile on the fabric to which the protecting means is to be secured. One of the upwardly and downwardly disposed means, preferably the two parallel rows of loops 56a, 56b, preferably are adjacent the side edges of the carrier strip. The other of the upwardly and downwardly disposed means, preferably the rows of loops 57 preferably is between the two parallel rows 56a, 56b but is secured to the opposite surface of the carrier strip 55.

As represented in FIG. 9, the carrier strip 55 may, for example, have end portion 58 which is bent and fits in the groove of a wind-up roll as represented in FIG. 10, which will be described more fully hereinafter.

Referring now more particularly to FIG. 11 of the drawings, the fabric portecting means is represented on a suitable wind-up roll 60 having a pile fabric 61 maintained in position by fabric protecting means at each end of the wind-up roll 60. The additional layers of the fabric 61 and the fabric protecting means are not represented in the drawings.

Referring to FIG. 13, it will be seen that the fabric protecting means has upwardly disposed means 56a, 56b and downwardly disposed means 57 which are jointly effective to mechanically grip and engage the fabric with the carrier strip 55 upon the upwardly and downwardly disposed means being placed into contact with the fabric in a rolled, wrapped configuration. This gripping and engagement is due to the compressive force at point 62 between the downwardly disposed means 57 and the carrier strip 55, the frictional forces between the fabric 61 and the upwardly disposed loops 56a and the downwardly disposed loops 57 and the upwardly disposed loops 56b, and the compressive forces between the upwardly disposed loops 56a, 56b and the carrier strip 55.

Referring now more particularly to FIGS. 14 to 17, a fabric protecting means comprises an elongate flexible carrier strip 65 which preferably is of metal. The fabric protecting means includes upwardly disposed means 66a, 66b integral with the carrier strip for engaging the fabric and downwardly disposed means 67 integral with the carrier strip 65 for engaging the fabric. The upwardly and downwardly disposed means 66a, 66b and 67 preferably comprise spiral rigid metal wire loops which may, for example, be welded to the carrier strip 65. The height of each of the upwardly and downwardly disposed means preferably is at least equal to the thickness of the fabric to be protected. The upwardly and downwardly disposed means 66a, 66b and 67 for engaging the fabric are closely spaced adjacent to each other. The upwardly and downwardly disposed means 66a, 66b and 67 are jointly effective to mechanically grip and engage the fabric with the carrier strip 65 upon the upwardly and downwardly disposed means 66a, 66b and 67 being placed into contact with the fabric in a rolled, wrapped configuration. The height of each of the upwardly and downwardly disposed means 66a, 66b and 67 is at least equal to the height of the pile on the fabric to which the protecting means is to be secured.

One of the upwardly and downwardly disposed means 66a, 66b and 67, preferably comprises the two parallel rows of loops 66a, 66b adjacent the side edges of the carrier strip and the other of the upwardly and downwardly disposed means preferably comprises the row of loops 67 between the two parallel rows but secured to the opposite surface of the carrier strip 65.

As represented in FIGS. 15 and 17, the combination in accordance with the invention comprises a pile fabric 68 the pile of which is to be protected and a pair of the fabric protecting means similar to the fabric protecting means of FIG. 14 for mechanically gripping and engaging the selvage edges of the fabric. As represented in FIG. 15, there is provided a wind-up roll 70 about and upon which the fabric with the fabric protecting means secured thereto is wrapped and rolled. The wind-up roll 70 has a circumferential groove 71 formed adjacent each of its axial ends into which the first wrap of the downwardly disposed fabric engaging means 67 is secured.

As represented in FIG. 17, the fabric 68 is compressed between the downwardly disposed loop 67 and the carrier strip 65 and between the upwardly disposed loops 66*a*, 66*b* and the carrier strip 65 of the second layer of winding. Also, the fabric 68 is in frictional engagement between the loops 66*a* and 67 and between the loops 66*b* and 67. The loops 66*a*, 66*b*, 67 are jointly effective to mechanically grip and engage the fabric with the carrier strip 65 when in contact with the fabric in a rolled, wrapped configuration.

The FIG. 14 embodiment provides substantially more gripping and engaging force than the FIG. 9 embodiment.

Referring now more particularly to FIGS. 18 to 21, the fabric protecting means comprises an elongate, flexible carrier strip 75 which preferably is of metal with apertures 75*a* therein for flexibility. The fabric protecting means includes upwardly disposed means 76*a*, 76*b* integral with the carrier strip 75 for engaging the fabric and downwardly disposed means 77 integral with the carrier strip 75 for engaging the fabric. One of the upwardly and downwardly disposed means 76*a*, 76*b* comprises two parallel rows of rods, which preferably are of metal, disposed in one of the upwardly and downwardly directions from the carrier strip. The other of the upwardly and downwardly disposed means 76*a*, 76*b*, 77, preferably the downwardly disposed means 77, comprises a row of rods 77 between the two parallel rows 76*a*, 76*b* but secured to the opposite surface of the carrier strip 75 and disposed in the other of the upwardly and downwardly directions from the carrier strip. The rows of rods 76*a*, 76*b*, 77 of the upwardly and downwardly disposed means are jointly effective to mechanically grip and engage the fabric with the carrier strip 75 upon being placed into contact with the fabric in a rolled, wrapped configuration.

The height of each of the upwardly and downwardly disposed means 76*a*, 76*b*, 77 preferably is at least equal to the thickness of the fabric to be protected. The rows of rods 76*a*, 76*b*, 77 are closely spaced adjacent to each other. The two parallel rows of rods 76*a*, 76*b* are adjacent to the side edges of the carrier strip and the row of rods 77 is between the two parallel rows of rods 76*a*, 76*b* but secured to the opposite surface of the carrier strip 75.

As represented in FIGS. 19 and 21, the combination in accordance with the invention comprises a velour pile fabric 78, the pile of which is to be protected and a pair of fabric protecting means similar to the fabric protecting means of FIG. 18 for mechanically gripping and engaging the selvage edges of the fabric. As represented in FIG. 19, there is provided a wind-up roll 80 about and upon which the fabric 78 with the fabric protecting means secured thereto is wrapped and rolled. The wind-up roll 80 has a circumferential groove 81 formed adjacent each of its axial ends into which the first wrap of the downwardly disposed fabric engaging means 77 is secured.

As represented in FIG. 21, the fabric 78 is compressed between the downwardly disposed rod 77 and carrier strip 75 and between the upwardly disposed rods 76*a*, 76*b* and the carrier strip 75 of the second layer of winding. Also, the fabric 78 is in the frictional engagement between the rods 76*a* and 77 and between the rods 76*b* and 77. The rods 76*a*, 76*b*, 77 are jointly effective to mechanically grip and engage the fabric with the carrier strip 75 when in contact with the fabric in a rolled, wrapped configuration.

Referring now more particularly to FIGS. 22 to 25, the fabric protecting means comprises an elongate, flexible carrier strip 85 which preferably is of metal. The fabric protecting means includes upwardly disposed means 86*a*, 86*b* integral with the carrier strip 85 for engaging the fabric and downwardly disposed means 87 integral with the carrier strip 85 for engaging the fabric. The upwardly and downwardly disposed means 86*a*, 86*b*, 87 comprise portions of the carrier strip extending upwardly and downwardly, respectively, therefrom. The portions 86*a*, 86*b*, 87 may be formed by punching the carrier strip 85. The height of each of the upwardly and downwardly disposed means 86*a*, 86*b*, 87 preferably is at least equal to the thickness of the fabric to be protected. The upwardly and downwardly disposed means 86*a*, 86*b* and 87 for engaging the fabric are closely spaced adjacent to each other. The upwardly and downwardly disposed means 86*a*, 86*b* and 87 are jointly effective to mechanically grip and engage the fabric with the carrier strip 85 upon the upwardly and downwardly disposed means 86*a*, 86*b* and 87 being placed into contact with the fabric in a rolled, wrapped configuration.

One of the upwardly and downwardly disposed means 86*a*, 86*b* and 87 preferably comprises the two parallel rows of portions 86*a*, 86*b* extending in one of the upwardly and downwardly directions from the carrier strip 85, and the other of the upwardly and downwardly disposed means 86*a*, 86*b*, 87 preferably comprises a row of portions 87 extending in the other of the upwardly and downwardly directions from the carrier strip and located between the two parallel rows 86*a*, 86*b*. The rows of portions 86*a*, 86*b*, 87 are closely spaced adjacent to each other.

Figure 22:
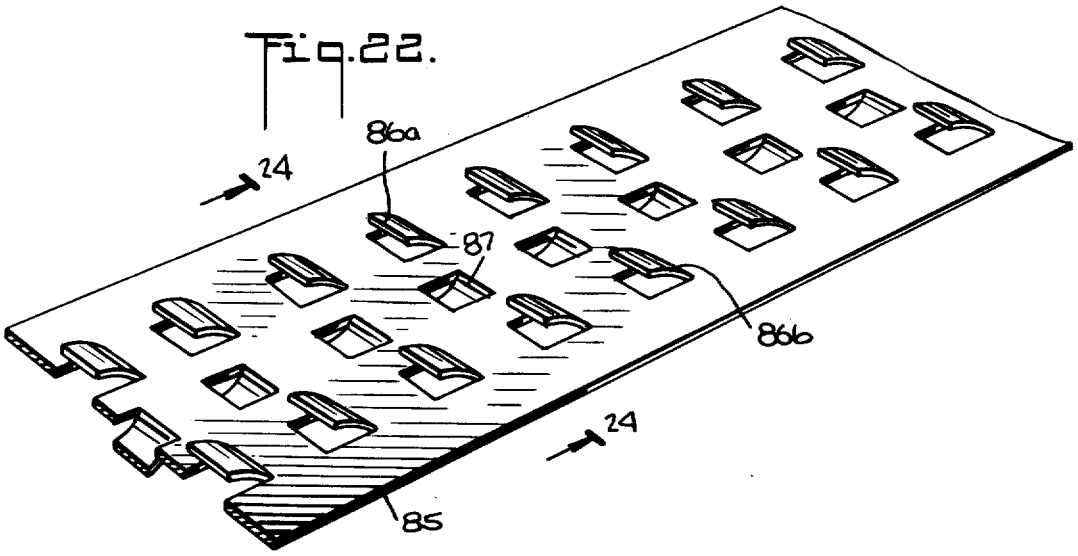
FIG. 22 is a perspective view of a preferred embodiment of the fabric protecting means constructed in accordance with the invention and particularly suitable for protecting velour pile fabrics.
Figure 23:
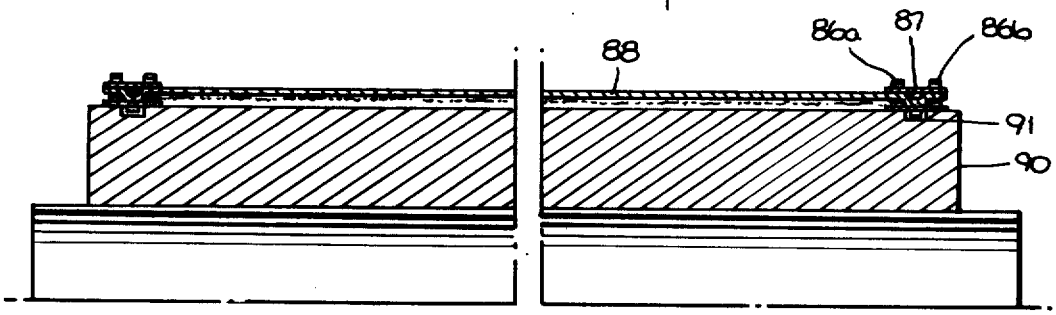
FIG. 23 is a fragmentary sectional view of the FIG. 12 fabric protecting means mounted on a roll similar to the wind-up roll of FIG. 5.
Figure 24:
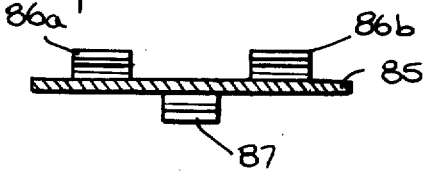
FIG. 24 is a sectional view of the FIG. 22 fabric protecting means taken along line 24—24 of FIG. 22.
Figure 25:
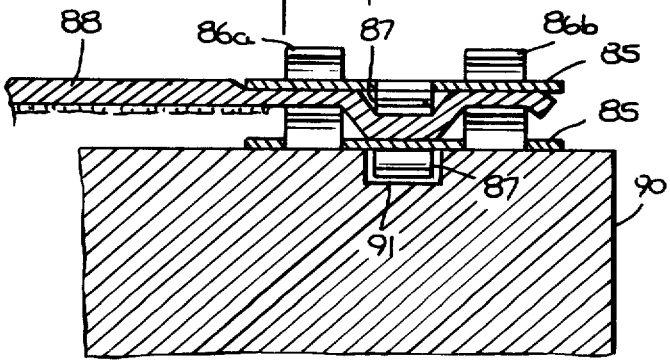
FIG. 25 is an enlarged fragmentary view of the FIG. 23 apparatus.
Figure 26:
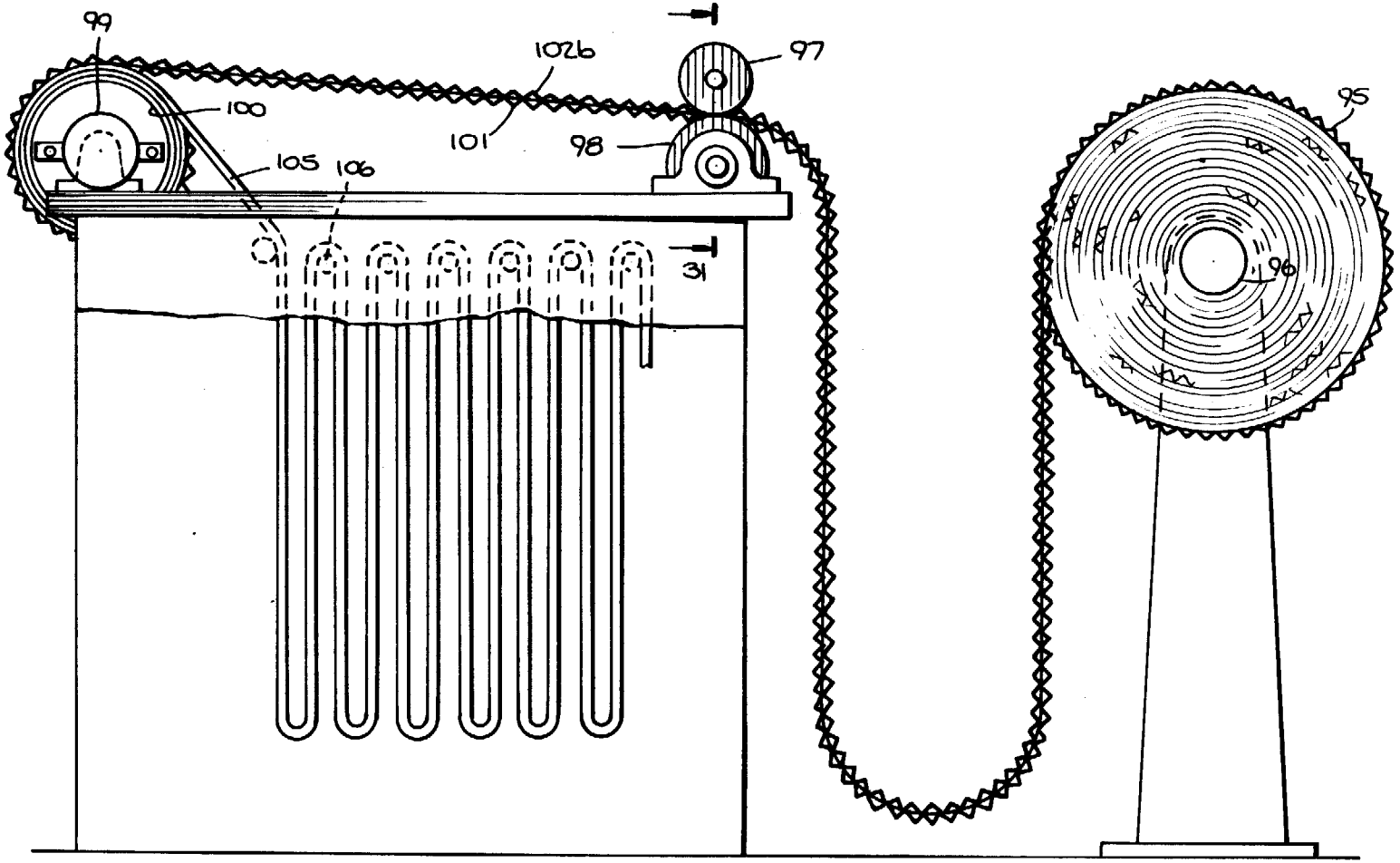
FIG. 26 is an elevational view, partly schematic, of an embodiment of associated apparatus which can be used to secure the fabric protecting means of the invention to a fabric with the fabric protecting means of FIG. 9 being represented for example.
Figure 27:
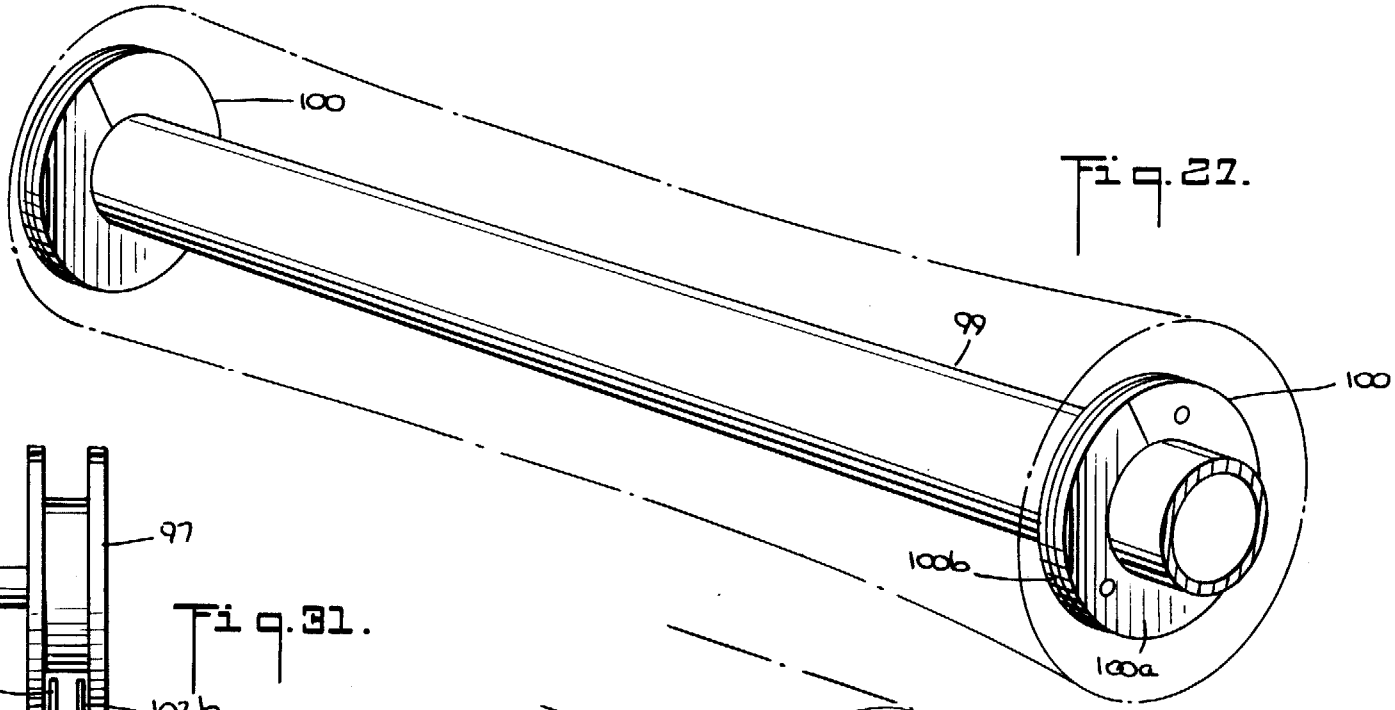
FIG. 27 is a prespective view of the wind-up roll of the FIG. 26 apparatus.
Figure 28:
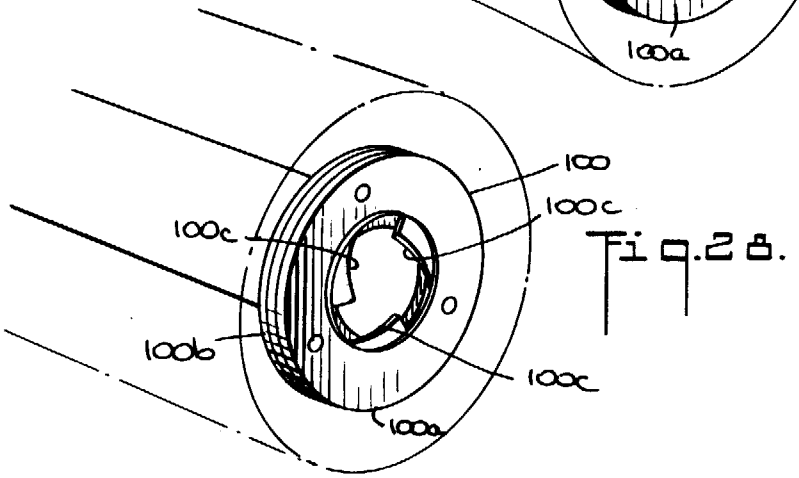
FIG. 28 is a fragmentary perspective view of one end of the wind-up roll of the FIG. 26 apparatus.

As represented in FIGS. 23 and 25, the combination in accordance with the invention comprises a velour pile fabric 88, the pile of which is to be protected and a pair of fabric protecting means similar to the fabric protecting means of FIG. 22 for mechanically gripping and engaging the selvage edges of the fabric. As represented in FIG. 23, there is provided a windup roll 90 about and upon which the fabric protecting means secured thereto is wrapped and rolled. The windup roll 90 has a circumferential groove 91 formed adjacent each of its axial ends into which the first wrap of the downwardly disposed fabric engaging means 87 is secured.

As represented in FIG. 25, the fabric 88 is compressed between the downwardly disposed portion 87 and the carrier strip 85 and between the upwardly disposed portions 86*a*, 86*b* and the carrier strip 85 of the second layer of winding. Also, the fabric 88 is in frictional engagement with the edges of the portions 86*a* and 86*b* and 87. The portions 86*a*, 86*b*, 87 are jointly effective to mechanically grip and engage the fabric with the carrier strip 85 when in contact with the fabric in a rolled, wrapped configuration. The FIG. 22 embodiment is a less expensive embodiment than the FIG. 18 embodiment and has a gripping force which is as effective as the FIG. 18 embodiment.

Referring now more particularly to FIGS. 26 to 30 of the drawings, there is represented another apparatus for applying a fabric protecting means 95 to each of the selvage edges of a fabric to be protected. For example, a pair of fabric protecting means, only one of which appears in FIG. 26, similar to the fabric protecting means of FIG. 9, are positioned in rolls on a suitable rotatable supporting roll 96. Each fabric protecting means 95 passes through a pair of suitable braking rolls 97, 98, one pair being represented in FIG. 26, and also being represented in section in FIG. 31 described more fully hereinafter, onto a suitable rotatable supporting roll 99 including rims 100, represented in perspective in FIG. 27. Each rim 100 includes a pair of parallel plates **100*a*, 100*b* having slits therein to receive the edge of the carrier of the fabric protecting means, in a manner similar to that represented in FIG. 10, and having a space therebetween for positioning the downwardly disposed means 101** for engaging the fabric.

Figure 31:
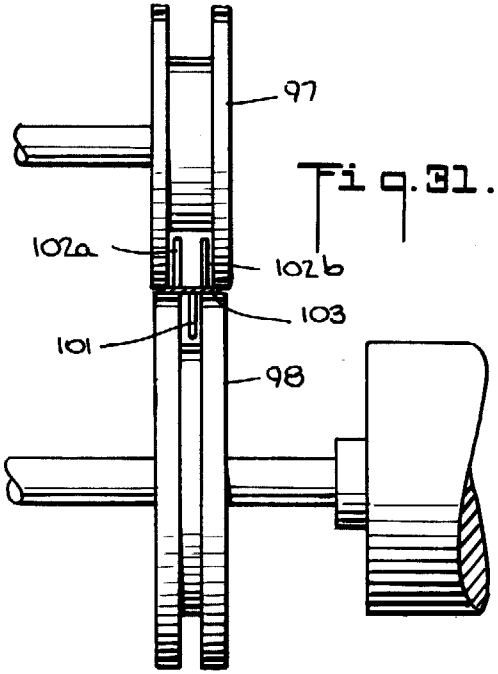
FIG. 31 is a fragmentary, enlarged, sectional view of braking apparatus of the FIG. 26 apparatus.

The fabric 105 is supported on suitable rolls 106 and is fed to the roll 99 which may be driven by a suitable motor (not shown), where it is engaged by the fabric protecting means at each of its selvage edges. The fabric protecting means 95 is maintained under the desired tension by the braking rolls 97, 98 which bear on the carrier 103 of the fabric protecting means, as represented in FIG. 31.

Figure 29:
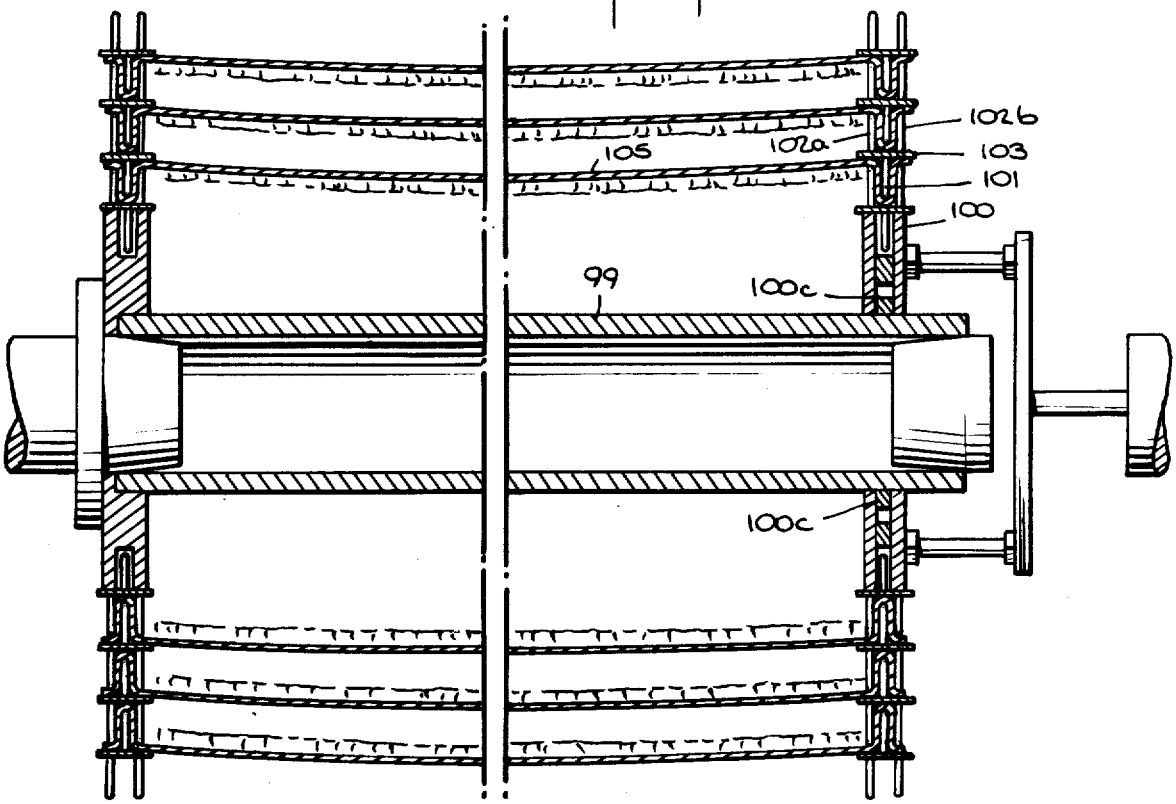
FIG. 29 is a sectional view of the wind-up roll and the fabric protecting means of the FIG. 26 apparatus.
Figure 30:
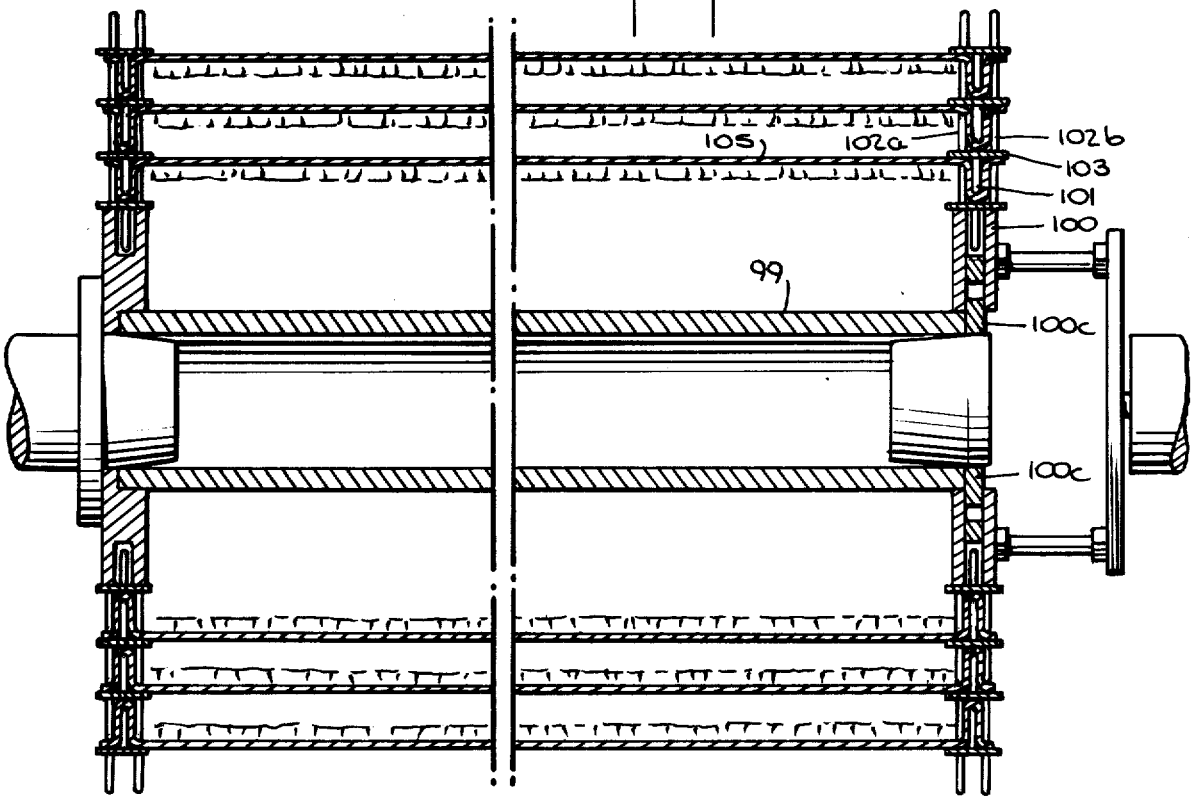
FIG. 30 is a sectional view of the wind-up roll and the fabric protecting means of the FIG. 26 apparatus at another stage of operation.

The fabric may be rolled on rims 100 without the application of lateral or transverse tension to form a roll of fabric 105 as indicated in FIG. 29. The right-hand rim 100, however, is displaceable on the roll 99, and after the fabric 105 has been rolled, the rim 100 represented near the right end of roll 99 in FIG. 27 may be moved axially of the roll 99 a distance of, for example, one inch to the point where spring-actuated fingers **100*c* snap inwardly of the roll 99 to reposition the rim 100 at the right end of the roll 99 and to apply the desired amount of lateral tension to the fabric 105**.

It will be understood that the various embodiments of the invention may be used more than once.

While there have been described what are at present considered to be the preferred embodiments of the invention, it will be obvious to those skilled in the art that various changes and modifications may be made therein without departing from the invention, and it is, therefore, aimed to cover all such changes and modifications as fall within the true spirit and scope of the invention.

What is claimed is:

1. A fabric protecting means for collecting, shipping and storing fabric, comprising an elongate, flexible carrier strip, upwardly disposed means integral with said carrier strip for gripping and engaging said fabric, and downwardly disposed means integral with said carrier strip for gripping and engaging said fabric, the height of each of said upwardly and downwardly disposed means being at least equal to the thickness of said fabric, and said carrier strip being sufficiently long and said upwardly and downwardly disposed means for gripping and engaging said fabric being closely spaced adjacent to each other such that said upwardly disposed means mechanically grips and engages said fabric with said downwardly disposed means upon being placed into contact with said fabric in a rolled, wrapped configuration in all successive wraps of said fabric.

2. A pile fabric protecting means for collecting, shipping and storing fabric comprising an elongate, flexible carrier strip, upwardly disposed means integral with said carrier strip for gripping and engaging said fabric, and downwardly disposed means integral with said carrier strip for gripping and engaging said fabric, said upwardly and downwardly disposed means for gripping and engaging said fabric each being at least equal to the height of the pile on the fabric to which said protecting means is to be secured, and said carrier strip being sufficiently long and said upwardly and downwardly disposed means for gripping and engaging said fabric being closely spaced adjacent to each other such that said upwardly disposed means mechanically grips and engages said fabric with said downwardly disposed means upon being placed into contact with said fabric in a rolled, wrapped configuration in all successive wraps of said fabric.

3. A pile fabric protecting means for collecting, shipping and storing fabric comprising an elongate, flexible carrier strip, upwardly disposed means integral with said carrier strip for gripping and engaging said fabric, and downwardly disposed means integral with said carrier strip for gripping and engaging said fabric, said upwardly and downwardly disposed means for gripping and engaging said fabric each being at least equal to the height of the pile on the fabric to which said protecting means is to be secured, and said upwardly and downwardly disposed means for gripping and engaging said fabric being closely spaced adjacent to each other such that said upwardly disposed means mechanically grips and engages said fabric with said downwardly disposed means upon being placed into contact with said fabric in a rolled, wrapped configuration, said upwardly disposed means for gripping and engaging said fabric being secured to one surface of said carrier strip and said downwardly disposed means for gripping and engaging said fabric being secured to the opposite surface of said carrier strip, said upwardly and downwardly disposed means for gripping and engaging said fabric each comprising parallel rows of a plurality of closed end loops, the protruding extremities of said closed end loops being closely spaced adjacent to each other such that said closed end loops of said upwardly disposed means mechanically grip and engage said fabric with said closed end loops of said downwardly disposed means upon being placed into contact with said fabric in a rolled, wrapped configuration.

4. The protecting means of claim 3 wherein said loops are made of rigid wire and are formed into a continuous wave-like configuration with each of said loops being about the same height, with the height of the loops comprising at least one of said gripping and engaging means being greater than the height of the pile of said fabric.

5. The protecting means of claim 3 wherein said parallel rows of loops have connecting ends and said connecting ends of said parallel rows of loops are secured to said carrier strip by means of an adhesive.

6. The protecting means of claim 5 wherein said connecting ends of said upwardly disposed loops and said downwardly disposed loops have respective longitudinal center lines and, when viewed through their respective longitudinal center lines, are completely offset from each other.

7. The protecting means of claim 5 wherein said connecting ends of said upwardly disposed loops and said downwardly disposed loops have respective longitudinal center lines and, when viewed through their respective longitudinal center lines, are offset from each other such that said connecting ends overlap each other at least about 50%.

8. The protecting means of claim 6 wherein said overlap is at least about 90%.

9. The combination which comprises a pile fabric, the pile of which is to be protected, a fabric protecting means mechanically gripping and engaging the selvage edges of said fabric, said fabric protecting means comprising an elongate, flexible carrier strip, upwardly disposed means for gripping and engaging said fabric and downwardly disposed means for gripping and engaging said fabric, said upwardly and downwardly disposed means being secured to opposite surfaces of said carrier strip and each comprising parallel rows of a plurality of closed end loops made of rigid wire and formed into a continuous wavelike configuration, the height of the pile in the fabric to be protected and the protruding extremities of said closed end loops being closely spaced adjacent to each other such that said closed end loops of said upwardly disposed means mechanically grip and engage said fabric with said closed end loops of said downwardly disposed means upon being placed into contact with said fabric with said upwardly disposed means engaging the fabric inwardly spaced from its selvage edge and said downwardly disposed means engaging the fabric adjacent its selvage edge.

10. The combination of claim 9 wherein said parallel rows of loops have connecting ends and said connecting ends of said parallel rows of loops are secured to said carrier strip by means of an adhesive.

11. The combination of claim 10 wherein said connecting ends of said upwardly disposed loops and said downwardly disposed loops have respective longitudinal center lines and, when viewed through their respective longitudinal center lines, are completely offset from each other.

12. The combination of claim 10 wherein said connecting ends of said upwardly disposed loops and said downwardly disposed loops have respective longitudinal center lines and, when viewed through their respective longitudinal center lines, are offset from each other such that said connecting ends overlap each other at least about 50%.

13. The combination of claim 12 wherein said overlap is at least about 90%.

14. The combination of claim 9 which includes a windup roll about and upon which said fabric with said fabric protecting means secured thereto is wrapped and rolled, said windup roll having a circumferential groove formed adjacent each of its axial ends into which the first wrap of said downwardly disposed fabric gripping and engaging means is secured.

15. The combination of claim 9 wherein the height of the loops comprising at least one of said gripping and engaging means is greater than the height of the pile of said fabric.

16. A fabric protecting means for collecting, shipping and storing fabric, comprising an elongate, flexible carrier strip; upwardly disposed means integral with said carrier strip for engaging said fabric; and downwardly disposed means integral with said carrier strip for engaging said fabric, the height of each of said upwardly and downwardly disposed means being at least equal to the thickness of said fabric, and said upwardly and downwardly disposed means for engaging said fabric being closely spaced adjacent to each other, said carrier strip being sufficiently long and said upwardly and downwardly disposed means being jointly effective to mechanically grip and engage said fabric with said carrier strip, upon said upwardly and downwardly disposed means being placed into contact with said fabric in a rolled, wrapped configuration in all successive wraps of said fabric.

17. The protecting means of claim 16 wherein said upwardly disposed means for engaging said fabric and said downwardly disposed means for engaging said fabric comprise portions of said carrier strip extending upwardly and downwardly, respectively, therefrom.

18. A pile fabric protecting means for collecting, shipping and storing fabric, comprising an elongate, flexible carrier strip; upwardly disposed means integral with said carrier strip for engaging said fabric; and downwardly disposed means integral with said carrier strip for engaging said fabric, the height of each of said upwardly and downwardly disposed means for engaging said fabric each being at least equal to the height of the pile on the fabric to which said protecting means is to be secured, and said downwardly and downwardly disposed means for engaging said fabric being closely spaced adjacent to each other, said carrier strip being sufficiently long and said upwardly and downwardly disposed means being jointly effective to mechanically grip and engage said fabric with said carrier strip, upon being placed into contact with said fabric in a rolled, wrapped configuration in all successive wraps of said fabric.

19. A pile fabric protecting means for collecting, shipping and storing fabric, comprising an elongate, flexible carrier strip; upwardly disposed means integral with said carrier strip for engaging said fabric; and downwardly disposed means integral with said carrier strip for engaging said fabric, the height of each of said upwardly and downwardly disposed means for engaging said fabric each being at least equal to the height of the pile on the fabric to which said protecting means is to be secured, and said upwardly and downwardly disposed means for engaging said fabric being closely spaced adjacent to each other, said upwardly and downwardly disposed means being jointly effective to mechanically grip and engage said fabric with said carrier strip, upon being placed into contact with said fabric in a rolled, wrapped configuration, one of said upwardly disposed means for engaging said fabric and said downwardly disposed means for engaging said fabric being secured to one surface of said carrier strip and the other of said upwardly disposed means for engaging said fabric and said downwardly disposed means for engaging said fabric being secured to the opposite surface of said carrier strip, one of said upwardly and downwardly disposed means comprising two parallel rows of loops adjacent the side edges of said carrier strip and the other of said upwardly and downwardly disposed means comprising a row of loops between said two parallel rows but secured to the opposite surface of said carrier strip, said loops of said upwardly and downwardly disposed means being jointly effective to mechanically grip and engage said fabric with said carrier strip upon being placed into contact with said fabric in a rolled, wrapped configuration.

20. The protecting means of claim 19 wherein said upwardly disposed means for engaging said fabric comprises said two parallel rows of loops adjacent said side edges of said carrier strip and said downwardly disposed means comprises said row of loops secured to the opposite surface of said carrier strip.

21. The protecting means of claim 19 wherein said rows of loops secured to said surfaces of said carrier strip individually comprise rigid wires extending continuously longitudinally along said carrier strip.

22. The combination which comprises a pile fabric, the pile of which is to be protected; a pair of fabric protecting means for mechanically gripping and engaging the selvage edges of said fabric; each of said fabric protecting means comprising an elongate, flexible carrier strip, upwardly disposed means for engaging said fabric and downwardly disposed means for engaging said fabric, said upwardly and downwardly disposed means being secured to opposite surfaces of said carrier strip, said upwardly disposed means comprising two parallel rows of loops adjacent the said edges of said carrier strip and made of rigid wire and said downwardly disposed means comprising a row of loops between said two parallel rows but secured to the opposite surface of said carrier strip and made of rigid wire, the height of said loops being at least equal to the height of the pile in the fabric to be protected and said rows of loops being closely spaced adjacent to each other, said loops of said upwardly and downwardly disposed means being jointly effective to mechanically grip and engage said fabric with said carrier strip when in contact with said fabric in a rolled, wrapped configuration.

23. The combination of claim 22 which includes a windup roll about and upon which said fabric with said fabric protecting means secured thereto is wrapped and rolled, said windup roll having a circumferential groove formed adjacent each of its axial ends into which the first wrap of said downwardly disposed fabric engaging means is secured.

24. A fabric protecting means for collecting, shipping and storing fabric, comprising an elongate, flexible carrier strip; upwardly disposed means integral with said carrier strip for engaging said fabric; and downwardly disposed means integral with said carrier strip for engaging said fabric, the height of each of said upwardly and downwardly disposed means being at least equal to the thickness of said fabric, and said upwardly and downwardly disposed means for engaging said fabric being closely spaced adjacent to each other, said upwardly and downwardly disposed means being jointly effective to mechanically grip and engage said fabric with said carrier strip, upon said upwardly and downwardly disposed means being placed into contact with said fabric in a rolled, wrapped configuration, said upwardly disposed means for engaging said fabric and said downwardly disposed means for engaging said fabric comprising portions of said carrier strip extending upwardly and downwardly, respectively, therefrom, one of said upwardly and downwardly disposed means comprising two parallel rows of portions extending in one of the upwardly and downwardly directions from said carrier strip and the other of said upwardly and downwardly disposed means comprising a row of portions extending in the other of said upwardly and downwardly directions from said carrier strip and located between said two parallel rows, said rows being closely spaced adjacent to each other and said portions of said upwardly and downwardly disposed means being jointly effective to mechanically grip and engage said fabric with said carrier strip, upon being placed into contact with said fabric in a rolled, wrapped configuration.

25. The protecting means of claim 24 in which said two parallel rows of portions of said carrier strip extend upwardly from said carrier strip and said row of portions of said carrier strip between said two parallel rows extends downwardly from said carrier strip.

26. The combination which comprises a fabric which is to be protected; a pair of fabric protecting means for mechanically gripping and engaging the selvage edges of said fabric, each of said fabric protecting means comprising an elongate, flexible carrier strip, upwardly disposed means for engaging said fabric and downwardly disposed means for engaging said fabric, said upwardly and downwardly disposed means comprising portions of said carrier strip extending upwardly and downwardly, respectively, therefrom, said upwardly disposed means comprising two parallel rows of portions of said carrier strip extending in the upwardly direction therefrom and said downwardly disposed means comprising a row of portions of said carrier strip located between said two parallel rows but extending downwardly from said carrier strip, the height of each of said upwardly and downwardly extending portions being at least equal to the thickness of said fabric, said rows of upwardly and downwardly extending portions being closely spaced adjacent to each other, said upwardly and downwardly extending portions being jointly effective to mechanically grip and engage said fabric with said carrier strip upon being placed into contact with said fabric in a rolled, wrapped configuration.

27. A fabric protecting means for collecting, shipping and storing fabric, comprising a elongate, flexible carrier strip; upwardly disposed means integral with said carrier strip for engaging said fabric; and downwardly disposed means integral with said carrier strip for engaging said fabric, the height of each of said upwardly and downwardly disposed means being at least equal to the thickness of said fabric, and said upwardly and downwardly disposed means for engaging said fabric being closely spaced adjacent to each other, said upwardly and downwardly disposed means being jointly effective to mechanically grip and engage said fabric with said carrier strip, upon said upwardly and downwardly disposed means being configuration, said upwardly disposed means for engaging said fabric being secured to one surface of said carrier strip and said downwardly disposed means for engaging said fabric being secured to the opposite surface of said carrier strip, one of said upwardly and downwardly disposed means for gripping and engaging said fabric comprising two parallel rows of rods disposed in one of the upwardly and downwardly directions from said carrier strip and the other of said upwardly and downwardly disposed means comprising a row of rods between said two parallel rows but secured to the opposite surface of said carrier strip and disposed in the other of the upwardly and downwardly directions from said carrier strip, said rows of rods being closely spaced adjacent to each other, said rods of said upwardly and downwardly disposed means being jointly effective to mechanically grip and engage said fabric with said carrier strip upon being placed into contact with said fabric in a rolled, wrapped configuration.

28. The protecting means of claim 27 wherein said upwardly disposed means for engaging said fabric comprises said two parallel rows of rods adjacent said side edges of said carrier strip and said downwardly disposed means comprises said row of rods secured to the opposite surface of said carrier strip.

29. The combination which comprises a fabric which is to be protected; a pair of fabric protecting means for mechanically gripping and engaging the selvage edges of said fabric; each of said fabric protecting means comprising an elongate, flexible carrier strip, upwardly disposed means for engaging said fabric and downwardly disposed means for engaging said fabric, said upwardly and downwardly disposed means comprising rows of rods secured to opposite surfaces of said carrier strip, said upwardly disposed means comprising two parallel rows of rods adjacent the side edges of said carrier strip and said downwardly disposed means comprising a row of rods between said two parallel rows but secured to the opposite surface of said carrier strip, the thickness of said rods being at least equal to the thickness of said fabric and said rows of rods being closely spaced adjacent to each other, said rods of said upwardly and downwardly disposed means being jointly effective to mechanically grip and engage said fabric with said carrier strip, when in contact with said fabric in a rolled, wrapped configuration.

30. The combination of claim 29 which includes a windup roll about and upon which said fabric with said fabric protecting means secured thereto is wrapped and rolled, said windup roll having a circumferential groove formed adjacent each of its axial ends into which the first wrap of said downwardly disposed fabric engaging means is secured.

* * * * *